United States Patent [19]

D'Ath

[11] 4,032,182

[45] June 28, 1977

[54] PET DROPPING PICKUP DEVICE

[76] Inventor: Philip O. D'Ath, 10455 N. Lynn Circle, "F", Mira Loma, Calif. 91752

[22] Filed: Feb. 27, 1976

[21] Appl. No.: 661,995

[52] U.S. Cl. ..... 294/19 R; 294/103 R; 294/22; 15/257.6

[51] Int. Cl.[2] ..... A01K 29/00

[58] Field of Search ..... 294/19 R, 1 R, 55, 57, 294/53.5, 50.9, 100, 103, 85, 22, 23; 119/1 R; 15/257.1, 257.6

[56] References Cited

UNITED STATES PATENTS

| | | | |
|---|---|---|---|
| 747,376 | 12/1903 | Christman | 294/22 |
| 953,756 | 4/1910 | Olson | 15/257.6 |
| 2,317,688 | 4/1943 | McDonald | 294/103 R |
| 2,999,259 | 9/1961 | Polner | 15/257.1 |
| 3,788,692 | 1/1974 | Fischer | 294/19 R |
| 3,868,135 | 2/1975 | Magliaro | 294/19 R |

*Primary Examiner*—James B. Marbert
*Attorney, Agent, or Firm*—Clarence A. O'Brien; Harvey B. Jacobson

[57] ABSTRACT

An upstanding handle is provided and supports an L-shaped angle member at its lower end including an upper upstanding flange to which the lower end of the handle is secured and a lower horizontal flange projecting outwardly from the lower edge of the upstanding flange. The upper upstanding flange includes horizontally outwardly projecting guide structure extending over and outwardly beyond the horizontal flange and an upstanding blade is dependingly supported from the guide structure for movement therealong toward and away from the side of the upstanding flange facing the direction in which the lower horizontal flange projects. The lower marginal edge portion of the blade is spaced slightly above the plane of the lower horizontal flange and is therefore movable inwardly over the lower horizontal flange toward the upstanding flange. An elongated flexible thrust transmitting structure extends downwardly along the upstanding handle to the level of the guide structure and then curves outwardly and is secured to the blade. Suitable guide structure for the thrust transmitting structure is provided at points spaced along the handle and adjacent the upper marginal edge portion of the upstanding flange whereby the upper portion of the thrust transmitting structure extending along the handle may be pushed downwardly and pulled upwardly in order to cause the blade to shift away from and back toward, respectively, the upstanding flange.

11 Claims, 10 Drawing Figures

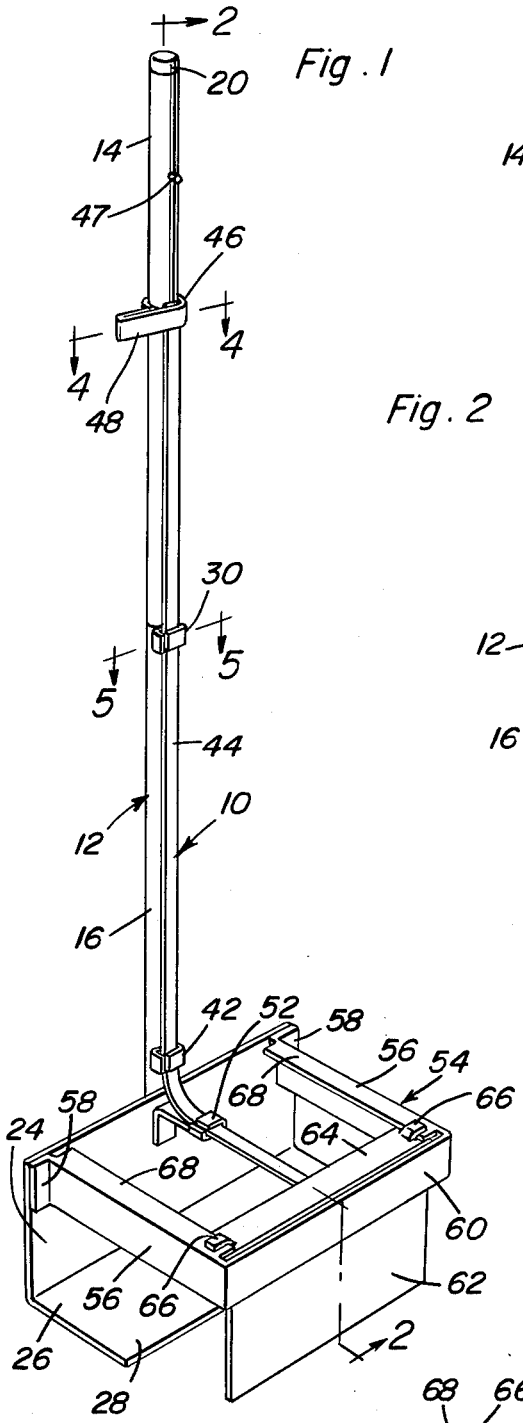
Fig. 1
2
20
14
47
46
4
4
48
30
5
5
44
12
10
16
42
52
58
56
54
66
68
64
24
58
68
60
62
56
66
26
28
2
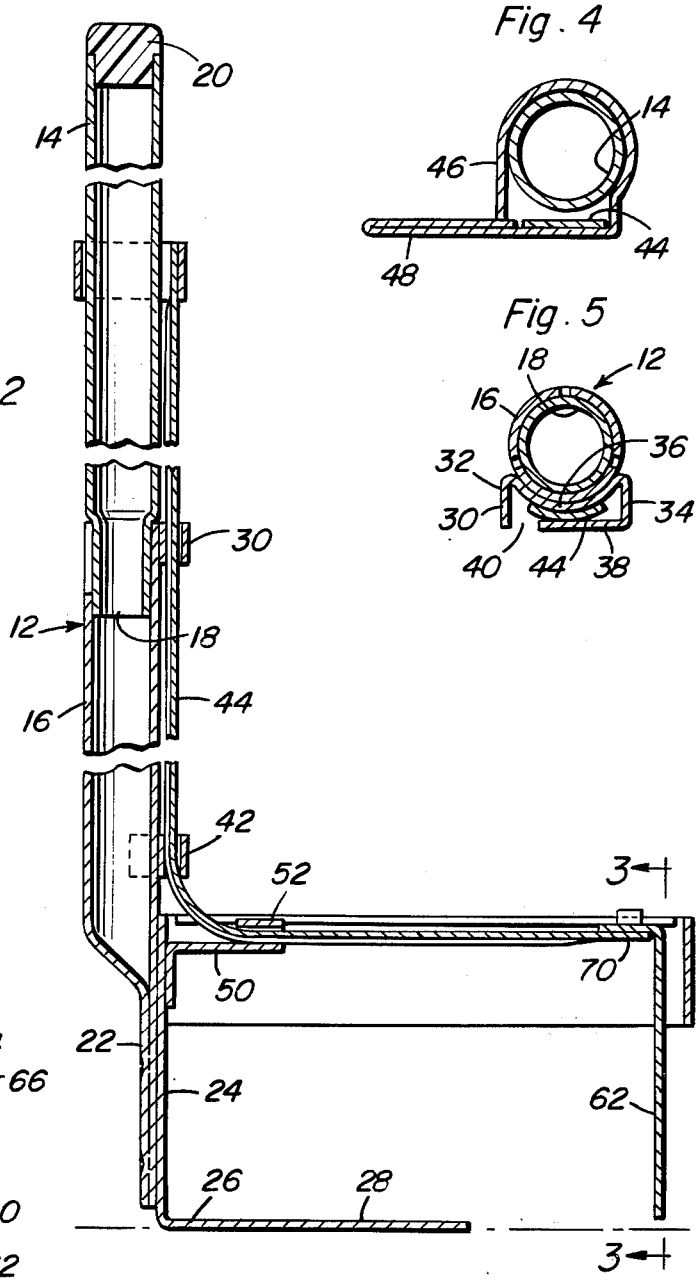
Fig. 2
20
14
30
12
18
16
44
42
52
3
50
70
22
24
62
26
28
3
Fig. 4
14
46
44
48
Fig. 5
18
12
16
36
32
34
30
40
44
38
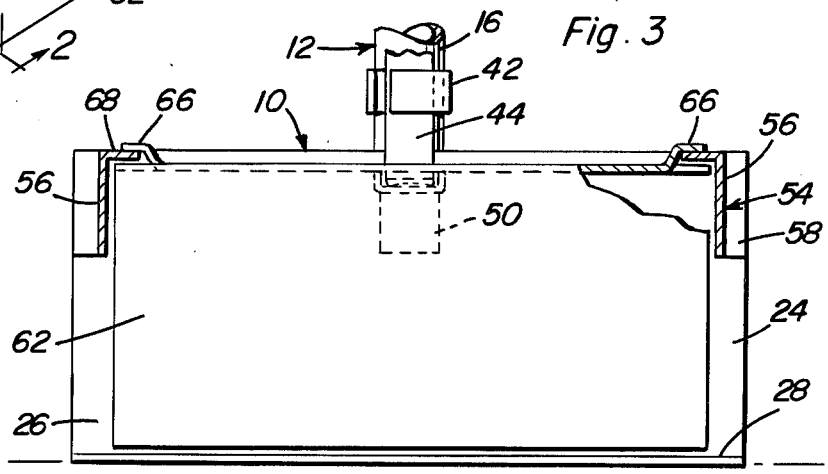
Fig. 3
12
16
42
44
10
68
66
66
56
56
54
50
58
62
24
26
28
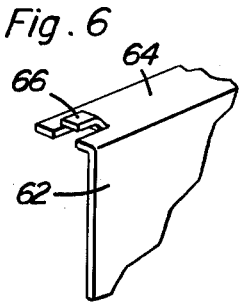
Fig. 6
66
64
62

PET DROPPING PICKUP DEVICE

BACKGROUND OF THE INVENTION

Various forms of pickup devices have been heretofore designed for various purposes. However, most previously patented pickup devices include pivoted jaw members and are therefore not adaptable to picking up some types of articles or objects.

Examples of previously patented pickup devices including some of the general structural and operational features of the instant invention are disclosed in U.S. Pat. Nos. 2,695,488, 2,878,050, 3,264,028, 3,601,966, 3,716,263 and 3,733,098.

BRIEF DESCRIPTION OF THE INVENTION

The pickup device of the instant invention is constructed in a manner whereby various forms of articles or objects may be pickup therewith. As opposed to relatively pivotal article engaging and clamping jaws the pickup device of the instant invention includes a sliding blade movable toward and away from an abutment flange from which a right angled support flange extends, the blade being shiftable laterally toward the abutment flange over the pickup flange. The pickup device is provided with an elongated upstanding handle and an elongated flexible thrust transmitting structure extends downwardly along the handle and then curves outwardly toward and is anchored to the blade with suitable guide structure being provided adjacent the bend or curve in the thrust transmitting structure so as to retain the shape thereof as it bends outwardly toward the blade from the handle.

The main object of this invention is to provide a pickup device constructed in a manner adapting it for picking up various types of articles and objects.

Another object of this invention is to provide a pickup device which may have a major portion of its components constructed of sheet metal or plastic.

Yet another object of this invention is to provide a pickup device which does not require special skill to operate.

A still further object of this invention is to provide a pickup device of light weight construction.

A final object of this invention to be specifically enumerated herein is to provide a pickup device in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a first form of pickup device constructed in accordance with the present invention;

FIG. 2 is an enlarged fragmentary vertical sectional view taken substantially upon the plane indicated by the section line 2—2 of FIG. 1;

FIG. 3 is a fragmentary vertical sectional view taken substantially upon the plane indicated by the section line 3—3 of FIG. 2;

FIG. 4 is an enlarged horizontal sectional view taken substantially upon the plane indicated by the section line 4—4 of FIG. 1;

FIG. 5 is an enlarged horizontal sectional view taken substantially upon the plane indicated by the section line 5—5 of FIG. 1;

FIG. 6 is a fragmentary perspective view of one upper corner portion of the shiftable blade portion of the pickup device;

DETAILED DESCRIPTION OF THE INVENTION

Figure 7:
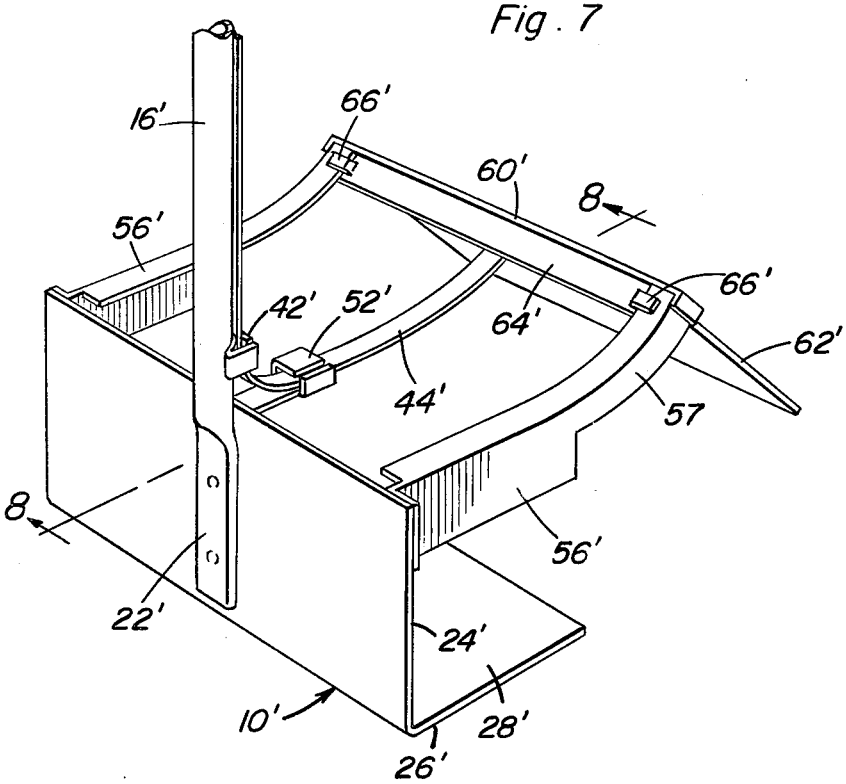
FIG. 7 is a fragmentary perspective view of the lower portion of a second form of the invention.

Referring now more specifically to the drawings, the numeral 10 generally designates the first form of pickup device. The pickup device 10 includes an upstanding handle assembly referred to in general by the reference numeral 12 and consisting of upper and lower telescopingly engaged sections 14 and 16. The upper section 14 includes a diametrically reduced lower end portion 18 which is wedgingly telescopingly received within a slotted upper terminal end of the lower section 16. The upper end of the tubular upper section 14 is closed by means of an end cap 20 and the lower end of the tubular lower section is flattened as at 22 and is secured to the rear surface of the upstanding flange 24 of an L-shaped member 26 including a horizontal flange 28 projecting forwardly from the lower marginal edge of the upstanding flange 14. The attachment of the flattened lower end portion 22 of the lower section 16 to the flange 24 may be accomplished in any suitable manner.

The slotted upper terminal end of the lower section 16 supports a guide structure 30 therefrom. The guide structure 30 includes a pair of generally parallel spaced apart upstanding flanges 32 and 34 interconnected by means of an arcuate connecting portion 36 extending therebetween. The connecting portion has its concave side abutted against and secured to the outer surface of the upper terminal end of the lower section 16. In addition, the free end of the flange 36 includes a right angled flange 38 which projects over the convex side of the connecting portion 36 toward but terminating a spaced distance from the flange 32 so as to define a slot 40 opening into the guide structure 30.

The lower end of the lower section 16 includes a guide structure 42 similar to the guide structure 30 and longitudinally spaced portions of an elongated, flexible and transversely arcuate metal strap 44 defining a thrust transmitting member are slidingly received through the guide structures 30 and 42. The strap 44 projects upwardly above the guide structure 30 along the upper section 14 and a sleeve member 46 including a laterally horizontally outwardly projecting handle portion 48 is slidably mounted on the upper section 14 and has the upper end of the strap 44 secured to the inner side of the forward portion of the sleeve 46. Accordingly, reciprocation of the sleeve 46 along the upper section 14 will cause the strap 44 to be shifted along the handle 12.

An L-shaped support bracket 50 is supported from the upper marginal portion of the forward face of the flange 24 and projects forwardly thereof. The bracket 50 includes a guide structure 52 on its forward end similar to the guide structures 30 and 42 and a generally U-shaped guide structure referred to in general by the reference numeral 54 is also supported from the front face of the flange 24 and projects forwardly thereof. The guide structure 54 includes a pair of front to rear extending transversely spaced angle members 56 including laterally and outwardly directed mounting tab portions 58 on their inner ends secured to the upper corner portions of the forward face of the flange 24. The outer ends of the angle members 56 are interconnected by means of an integral transverse upstanding flange 60 and it will be noted that the flange 60 generally parallels the flange 24.

An upstanding transversely extending blade 62 is provided and includes a rearwardly directed upper marginal edge flange 64. The opposite end portions of the flange 64 include upwardly struck tabs 66 and the blade 62 is guidingly supported from the angle members 56 with the tabs 66 overlying the upper surfaces of the horizontal flanges 68 of the angle members 56 and the remaining portions of the opposite ends of the flange 64 received beneath the upper flanges 68 of the angle members 56. Still further, the forward end of the forwardly directed lower end portion of the strap 44 is secured to the undersurface of the central portion of the flange 64 as at 70. Accordingly, movement of the handle 48 upward and downward along the upper section 14 of the handle 12 will cause the blade 62 to shift toward and away from the flange 24. In addition, it will be noted that the lower marginal edge portion of the blade 62 is spaced above the plane of the lower horizontal flange 28. Accordingly, when the blade 62 is pulled toward the flange 24 by the strap 44, the blade 62 will pass closely over the flange 28.

Figure 8:
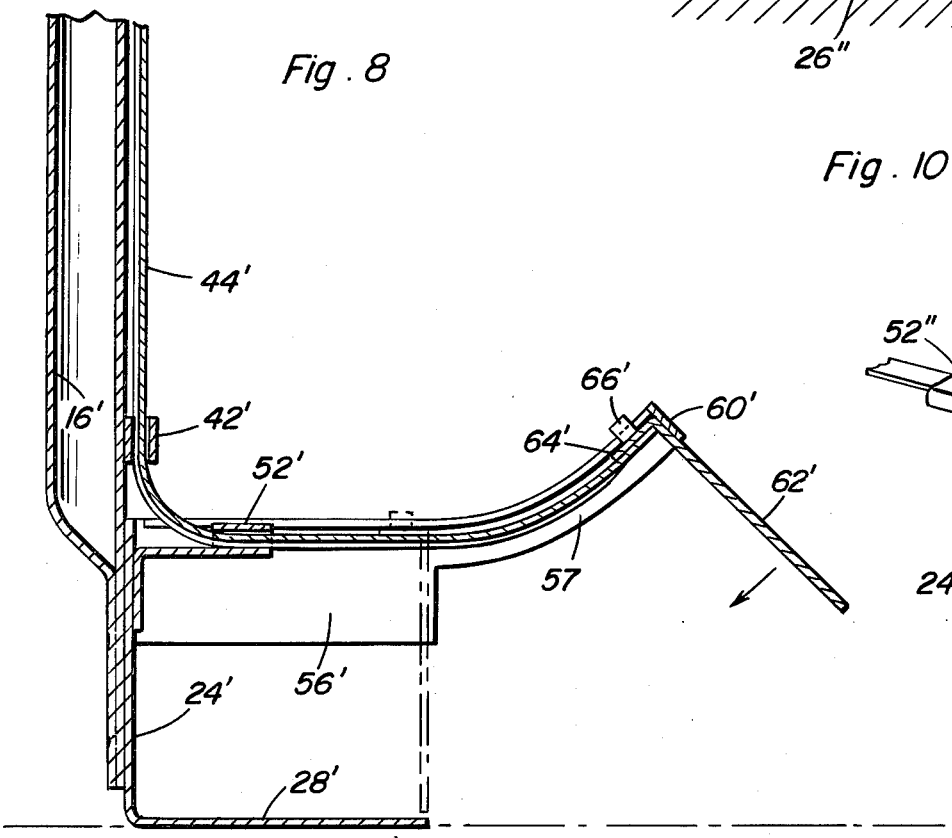
FIG. 8 is an enlarged fragmentary vertical sectional view taken substantially upon the plane indicated by the section line 8—8 of FIG. 7.

With attention now invited more specifically to FIGS. 7 and 8 of the drawings, there will be seen a modified form of pickup device referred to in general by the reference numeral 10'. The pickup device 10' is similar in many respects to the pickup device 10 and components of the pickup device 10' corresponding to similar components of the pickup device 10 are designated by corresponding prime reference numerals.

The basic difference between the pickup device 10' and pickup device 10 is that the outer end portions of the angle members 56' of the pickup device 10' curve upwardly as at 57. In addition, the flange 60' corresponding to the flange 60 is not formed as an integral portion of the angle members 56', but comprises a separate component extending between and secured to the free ends of the upwardly curving forward end portions of the angle members 56'. Accordingly, when the plate 62' is shifted away from the flange 24', it initially moves in a horizontal direction until the plate 62' is shifted outward of the free marginal edge of the flange 28'. Thereafter, further outward movement of plate 62' causes the latter to swing upwardly along the upwardly curving outer end portions 57 of the angle members 56' to the outer limit position thereof illustrated in FIG. 8 of the drawings. Of course, it will be noted from a comparison of FIGS. 2 and 8 of the drawings that the pickup device 10' is operable to pick up larger articles than can be picked up by the pickup device 10.

Figure 9:
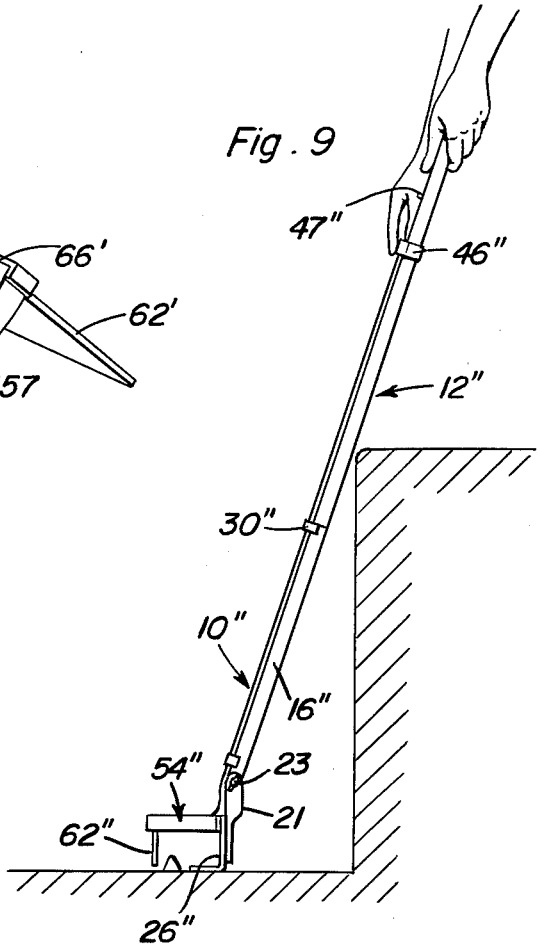
FIG. 9 is a side elevational view of a third form of the invention.
Figure 10:
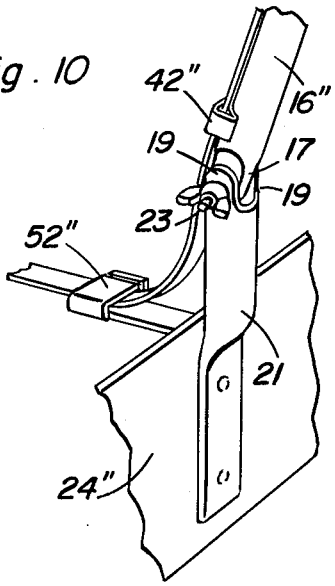
FIG. 10 is a fragmentary perspective view of the lower portion of the pickup device shown in FIG. 9 and illustrating the structure by which the lower end of the handle pivotally supports the remainder of the third form of pickup device therefrom.

With attention invited more specifically to FIGS. 9 and 10 of the drawings, it will be seen yet another modified form of the invention referred to in general by the reference numeral 10''. The various components of the pickup device 10'' which correspond to similar components of the device 10 are referred to by corresponding double prime reference numerals.

The pickup device 10'' differs from the pickup device 10 in that the lower section 16'' of the handle 12'' is transversely flattened as at 17 and is pivotally secured between upstanding opposite side furcations 19 of an upstanding mount 21 secured to the rear side of the flange 24''. The pivotal connection between the flattened lower end portion 17 and the furcations 19 is effected by a removable pivot fastener 23. Of course, the guide structures 42'' and 52'' are spaced closely adjacent the pivotal connection defined by the pivot fastener 23 and the transversely arcuate flexible thrust transmitting strap 44 is unaffected in its operation as a result of relative angular displacement of the lower section 16'' relative to the mount 21.

From FIG. 9 of the drawings, it may be seen that the pickup device 10' may be used in circumstances in which neither of the devices 10 and 10' are convenient to use.

Further, from FIGS. 1 and 9 of the drawings it may be seen that the upper sections 14 and 14'' include stop pins 47 and 47'', respectively, to limit upward movement of the sleeve members 46 and 46'' and thus inward movement of the blades 62 and 62'' toward the flanges 24 and 24'' to positions with the blades 62 and 62'' spaced inwardly over the outer one-third of the corresponding flanges 28 and 28''. Of course, the pickup device 10' will also be provided with a similar stop pin (not shown). Thus, if the devices 10, 10' and 10'' are used to pickup pet droppings, the material picked up may not be squeezed between the blades 62, 62' and 62'' and the flanges 24, 24' and 24'', respectively.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A pickup device including an upstanding handle, an L-shaped angle member including a lower horizontal flange and an upstanding flange supported at its lower edge from one marginal edge portion of said horizontal flange, mounting means supporting said upstanding flange from the lower end of said handle, guide means supported from and projecting outwardly of the upstanding flange spaced above said horizontal flange, a depending plate guidingly supported from said guide means for movement therealong toward and away from the upstanding flange over said horizontal flange, said plate being outwardly shiftable along said guide means to a position spaced outwardly of the outer marginal portion of said horizontal flange, control means shiftably supported from an upper portion of said handle, and thrust transfer means operably connected between said control means and said plate operable to shift the latter in response to shifting of said control means, said guide means including a pair of elongated inwardly and downwardly opening parallel angle members including upper horizontal flanges projecting toward each other and depending lower flanges depending from the remote marginal edges of said upper horizontal flanges, said angle members being supported from and projecting outwardly from opposite end portions of the upper marginal portion of said upstanding flange, the upper marginal edge portion of said depending plate including a substantially right angulated horizontal flange projecting toward said upstanding flange, the opposite ends of said right angulated horizontal flange including upwardly struck and offset end tabs, the terminal ends of said right angulated flanges being slidably engaged with said upper horizontal flanges with said end tabs engaged over said upper horizontal flanges and the remainder of each terminal end of said right angulated horizontal flange closely underlying the corresponding upper horizontal flange, the end portions of the upper marginal edge of said depending plate being closely received between the opposing surfaces of said depending lower flanges.

2. The combination of claim 1 wherein said thrust transfer means includes an elongated transversely arcuate flexible strap member extending downwardly along said handle and having a lower end portion curving outwardly toward and connected to said plate, said handle and upstanding flange including guide structures guidingly engaged with said strap on opposite sides of the curved portion thereof.

3. The combination of claim 2 wherein said control means includes a slide mounted on an upper portion of said handle for shifting therealong and to which the upper end of said strap is anchored.

4. The combination of claim 1 wherein said parallel angle members extend in a substantially straight paths outwardly from said upstanding flange throughout at least substantially the entire effective length of said guide means.

5. The combination of claim 4 wherein said handle is rigid relative to said upstanding flange.

6. The combination of claim 4 wherein said mounting means includes means pivotally supporting said angle member from the lower end portion of said handle for oscillation about a horizontal axis transverse to the path of movement of said plate relative to said upstanding flange.

7. A pickup device including an upstanding handle, an L-shaped angle member including a lower horizontal flange and an upstanding flange supported at its lower edge from one marginal edge portion of said horizontal flange, mounting means supporting said upstanding flange from the lower end of said handle, guide means supported from and projecting outwardly of the upstanding flange spaced above said horizontal flange, a depending plate guidingly supported from said guide means for movement therealong toward and away from the upstanding flange over said horizontal flange, said plate being outwardly shiftable along said guide means to a position spaced outwardly of the outer marginal portion of said horizontal flange, control means shiftable supported from an upper portion of said handle, and thrust transfer means operably connected between said control means and said plate operable to shift the latter in response to shifting of said control means, the outer portion of said guide means including guide portions thereof with which said plate is guidingly engaged for causing said guide plate to swing upwardly during the terminal portion of its movement away from said upstanding plate.

8. The combination of claim 4 wherein said mounting means includes means pivotally supporting said angle member from the lower end portion of said handle for oscillation about a horizontal axis transverse to the path of movement of said plate relative to said upstanding flange, and means operative to releasably retain said angle member in adjusted angularly displaced positions relative to said handle.

9. The combination of claim 7 wherein said thrust transfer means includes an elongated transversely arcuate flexible strap member extending downwardly along said handle and having a lower end portion curving outwardly toward and connected to said plate, said handle and upstanding flange including guide structures guidingly engaged with said strap on opposite sides of the curved portion thereof.

10. The combination of claim 9 wherein said control means includes a slide mounted on an upper portion of said handle for shifting therealong and to which the upper end of said strap is anchored.

11. The combination of claim 10 wherein said slide and handle include coacting means limiting movement of said slide along said handle.

* * * * *